US009539472B2

(12) United States Patent
Smith et al.

(10) Patent No.: US 9,539,472 B2
(45) **Date of Patent: *Jan. 10, 2017**

(54) SOCCER BALL WITH MOTION GRAPHIC

(71) Applicant: Nike, Inc., Beaverton, OR (US)

(72) Inventors: Todd Smith, West Linn, OR (US); Alan W. Reichow, Beaverton, OR (US); Karl Citek, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/943,306

(22) Filed: Jul. 16, 2013

(65) Prior Publication Data

US 2014/0024484 A1 Jan. 23, 2014

Related U.S. Application Data

(63) Continuation of application No. 11/801,931, filed on May 11, 2007, now Pat. No. 8,512,180, which is a continuation-in-part of application No. 29/250,775, filed on Nov. 30, 2006, now Pat. No. Des. 548,292, and a continuation-in-part of application No. 29/250,773, filed on Nov. 30, 2006, now Pat. No. Des. 548,806, and a continuation-in-part of application No. 29/250,770, filed on Nov. 30, 2006, now abandoned, and a continuation-in-part of application No. 10/770,862, filed on Feb. 2, 2004, now Pat. No. 8,360,905.

(51) Int. Cl.
*A63B 41/08* (2006.01)
*A63B 43/00* (2006.01)

(52) U.S. Cl.
CPC ..... *A63B 43/008* (2013.01); *A63B 2243/0025* (2013.01)

(58) Field of Classification Search
CPC ..... A63B 41/08; A63B 43/008; A63B 2243/0025
USPC ..... 40/327; D21/707–709, 712, 713
See application file for complete search history.

(56) References Cited

U.S. PATENT DOCUMENTS

| | | | | | |
|---|---|---|---|---|---|
| 676,506 | A | * | 6/1901 | Knight | 40/327 |
| D194,688 | S | * | 2/1963 | Santora | D21/708 |
| 3,425,693 | A | * | 2/1969 | Murray | 40/327 |
| 3,861,790 | A | | 1/1975 | Tamura | |

(Continued)

OTHER PUBLICATIONS

Reichow, et al., "Introduction to Behavioral Optometry", Sports Vision, 1993, 75 pages, Optometric Extension Program Foundation, United States.

(Continued)

*Primary Examiner* — Steven Wong
(74) *Attorney, Agent, or Firm* — Shook, Hardy & Bacon L.L.P.

(57) ABSTRACT

Balls for team and individual sports include a motion graphic that provides enhanced perception of ball rotation. The motion graphic is typically defined with a visual characteristic that contrast with a ball casing. The motion graphic includes first and second termination portions that are coupled by a connection region. The first and second termination portions are symmetrically situated with respect to a longitudinal axis and are asymmetric with respect to axes perpendicular to the longitudinal axis. The motion graphic and the ball casing can be provided with substantially opposite colors selected to exhibit similar or substantially the same reflectivities.

18 Claims, 5 Drawing Sheets

(56) References Cited

U.S. PATENT DOCUMENTS

| | | | | | |
|---|---|---|---|---|---|
| 4,345,759 | A | * | 8/1982 | Nims | 473/569 |
| 4,796,888 | A | * | 1/1989 | Louez | 40/327 |
| 4,867,452 | A | * | 9/1989 | Finley | 473/569 |
| 4,991,838 | A | * | 2/1991 | Groves | 473/451 |
| 5,050,982 | A | | 9/1991 | Meissner | |
| 5,067,719 | A | * | 11/1991 | Mook | 40/327 |
| D355,685 | S | * | 2/1995 | Ross | D21/712 |
| 5,419,552 | A | * | 5/1995 | Meyer | 473/604 |
| 5,427,372 | A | * | 6/1995 | Ratner et al. | 156/147 |
| 5,478,239 | A | | 12/1995 | Fuerst | |
| 5,711,725 | A | * | 1/1998 | Bengtson | 473/598 |
| 5,713,799 | A | * | 2/1998 | Balmat | 473/200 |
| 5,778,793 | A | * | 7/1998 | Mello et al. | 473/353 |
| D418,565 | S | * | 1/2000 | Burgess | D21/713 |
| 6,331,151 | B2 | * | 12/2001 | Calandro | 473/599 |
| D452,721 | S | * | 1/2002 | Sonntag | D21/713 |
| 6,375,783 | B1 | * | 4/2002 | Davis | 40/327 |
| 6,755,525 | B2 | | 6/2004 | Reichow | |
| 6,811,258 | B1 | | 11/2004 | Grant | |
| D504,709 | S | * | 5/2005 | Chang | D21/712 |
| 6,893,127 | B2 | | 5/2005 | Reichow | |
| D509,550 | S | * | 9/2005 | Nishihara | D21/713 |
| D511,192 | S | * | 11/2005 | Nishihara | D21/713 |
| D516,642 | S | * | 3/2006 | Swiszcz et al. | D21/713 |
| D516,646 | S | * | 3/2006 | Yang | D21/713 |
| D518,862 | S | * | 4/2006 | Swiszcz et al. | D21/713 |
| D520,086 | S | * | 5/2006 | Just et al. | D21/707 |
| 7,073,208 | B2 | | 7/2006 | Penque | |
| D548,292 | S | * | 8/2007 | Smith | D21/713 |
| D548,806 | S | * | 8/2007 | Smith | D21/713 |
| 8,360,905 | B2 | * | 1/2013 | Boyer et al. | 473/604 |
| 8,512,180 | B2 | * | 8/2013 | Smith et al. | 473/604 |
| 2005/0221919 | A1 | * | 10/2005 | Eite | 473/446 |

OTHER PUBLICATIONS

Ferreira, "An Overview of Research in Sports Vision: its History and an Optometric Perspective", The South African Optometrist, Dec. 2003, pp. 142-149, vol. 62, No. 4, Auckland Park, South Africa.

Coffey, et al., "Visual Performance Enhancement in Sports Optometry", Sports Vision 1995, pp. 158-177, Butterworth-Heinermann, United States.

Cardall, "Contact Lenses in Sport: a General Overview", Optician, Jan. 13, 2006, pp. 22-25, vol. 231, No. 6034, United States.

Rouse, et al., "A Comparison Study of Dynamic Visual Acuity Between Athletes and Nonathletes", Journal of the American Optometric Association, Dec. 1988, pp. 946-950, vol. 59, No. 12, United States.

Koenig, "Practicing Perception: Eyes Can Be Trained to be More Effective", USA Today Baseball Weekly, 1996, 3 pages, United States.

Coffey, et al., "Optometric Evaluation of the Elite Athlete," Problems in Optometry, Mar. 1990, pp. 32-59, vol. 2, No. 1, United States.

Reichow, et al., "A Comparison of Contrast Sensitivity in Elite Athletes Versus a Normal Population", American Journal of Optometry and Physiological Optics, Dec. 15, 1986, vol. 63, No. 82, United States.

Farrow, et al., "An Investigation of the Effectiveness of Bolle's Competivision Sport-Glasses on Tennis Performance", Clinical and Experimental Optometry, Jul.-Aug. 2000, pp. 226-231, vol. 83, No. 4.

Herdman, et al., "Computerized Dynamic Visual Acuity Test in the Assessment of Vestibular Deficits", The American Journal of Otology, 1998, pp. 790-796, vol. 19, No. 6, United States.

Tian, et al., "Dynamic Visual Acuity During Transient and Sinusoidal Yaw Rotation in Normal Ulilaterally Vestibulopathic Humans", Experimental Brain Research, Feb. 8, 2001, pp. 12-25, vol. 137, Springer-Verlag, United States.

Reichow, et al., "Ultraviolet and Short Wavelength Visible Light Exposure: Why Ultraviolet Protection Alone is Not Adequate", Journal of Long-Term Effects of Medical Implants, 2006, pp. 315-325, vol. 16, No. 4, Begell House, Inc., United States.

* cited by examiner

SOCCER BALL WITH MOTION GRAPHIC

CROSS-REFERENCE TO RELATED APPLICATIONS

This application is a continuation of U.S. application Ser. No. 11/801,931, filed May 11, 2007, entitled "Soccer Ball With Motion Graphic granted U.S. Pat. No. 8,512,180," which is a continuation-in-part of U.S. Design application No. 29/250,775, filed Nov. 30, 2006, entitled "Ball", granted U.S. Pat. No. D548,292, U.S. Design patent application Ser. No. 29/250,773, filed Nov. 30, 2006, entitled "Ball", granted U.S. Pat. No. D548,806, U.S. Design patent application Ser. No. 29/250,770, filed Nov. 30, 2006, entitled "Ball", and U.S. patent application Ser. No. 10/770,862, filed Feb. 2, 2004, entitled "Chromatic Architecture For Sports Equipment," granted U.S. Pat. No. 8,360,905, all of which are incorporated herein by reference.

CROSS REFERENCE TO RELATED APPLICATIONS

The present application is a continuation-in-part of U.S. Design patent application Ser. Nos. 29/250,770, filed Nov. 30, 2006, 29/250,773, filed Nov. 30, 2006, and 29/250,775, filed Nov. 30, 2006 that are incorporated herein by reference.

FIELD

The disclosure pertains to graphics that permit enhanced perception of object motion, including rotation, particularly for balls used in team and individual athletics.

BACKGROUND

Improved athletic performance has been made possible by significant advances in athletic training, training aids, nutrition, equipment and apparel. Even amateur athletes have easy access to world class training programs and trainers, and sophisticated training methods and equipment are widely available to all. Athletes can also find equipment, uniforms, shoes, and apparel that are both stylish and functional. Advances in injury prevention and treatment reduce periods of inactivity. As a result, today's athletes, both professional and amateur, can have long athletic careers in which performance is consistently high.

Athletic apparel and safety equipment are two areas in which significant improvements have been made. For example, head gear for team and individual athletics has incorporated strong, lightweight materials, and designs have been realized that tend to safely dissipate energy received when the headgear is struck. Advanced athletic apparel provides temperature control, comfort, and freedom of motion under even the most demanding conditions.

While many advances have been made, the visual appearance of most athletic gear frequently provides only stylish appearance, and is typically colored, patterned, or decorated only to provide team identification and manufacturer or event logos. While such conventional gear is popular with participants and spectators, it does little to promote athletic performance. Thus improved athletic gear is needed in which visual appearance can contribute to athletic performance.

SUMMARY

Soccer balls include a first exterior field region associated with a first visual stimulus and a second exterior field region in which a motion graphic is defined. The motion graphic is defined based on a second visual stimulus that is substantially contrasting with the first visual stimulus, and includes first and second termination portions that are substantially symmetric with respect to a first longitudinal axis and asymmetric with respect to a second longitudinal axis that is perpendicular to the first longitudinal axis. The termination portions are partially coupled by a connection portion that extends substantially perpendicularly to the first longitudinal axis. In some examples, the connection portion extends from the first termination portion to the second termination portion.

In additional representative examples, the motion graphic further comprises an interior region within the connection portion and the termination portions and defined by the first visual stimulus. In some examples, the termination portions consist essentially of section of an annular ring. According to representative examples, this section of an annular ring extends along a semicircular arc. In some examples, a radius of the semicircular arc is less than about 4/5 of a radius of the soccer ball. In other examples, a height of the motion graphic along the first longitudinal axis is less than about 2/5 of a circumference of the soccer ball. In additional examples, the first and second termination portions of the motion graphic are substantially symmetric about the second longitudinal axis. In some examples, contrasting colors or spectrally opposite colors such as blue and yellow are used to define the first and second visual stimuli. In some examples, the blue and yellow colors are configured to have substantially equal effective average reflectances.

According to some examples, balls comprise an exterior casing and a motion graphic defined on the exterior casing. The motion graphic is defined by a perimeter that establishes end portions that are symmetric with respect to a ball longitude. The end portions are coupled by a connection region, and the perimeter defines a motion graphic interior and includes first, second, and third perimeter portions configured so as to exhibit selected visual characteristics substantially visually contrasting with respect to the exterior casing. In additional examples, the motion graphic is asymmetric with respect to any longitude perpendicular to the longitude about which the end portions are symmetric. In further examples, the first, second, and third perimeter portions are situated so that the first and third perimeter portions are the exterior-most and interior-most perimeter portions, respectively, and the second perimeter portion is situated between the first and third perimeter portions. In some example, the first and third perimeter portions are configured so as to exhibit a common visual characteristic.

In other examples, methods comprise defining a motion graphic that includes first and second pattern ends that are situated symmetrically with respect to a first longitudinal axis on an exterior casing of a ball, and configuring the motion graphic to exhibit a visual characteristic that is substantially contrasting with respect to the ball casing. In some examples, the visual characteristic exhibited by the ball casing and the motion graphic are substantially opposite. In further examples, each pattern end is substantially asymmetric with respect to any axis perpendicular to the first axis. According to some examples, the motion graphic is defined by a perimeter that exhibits two or more shades of a common color.

These and other features and aspects of the disclosure are set forth below with reference to the accompanying drawings.

DETAILED DESCRIPTION

Figure 1A:
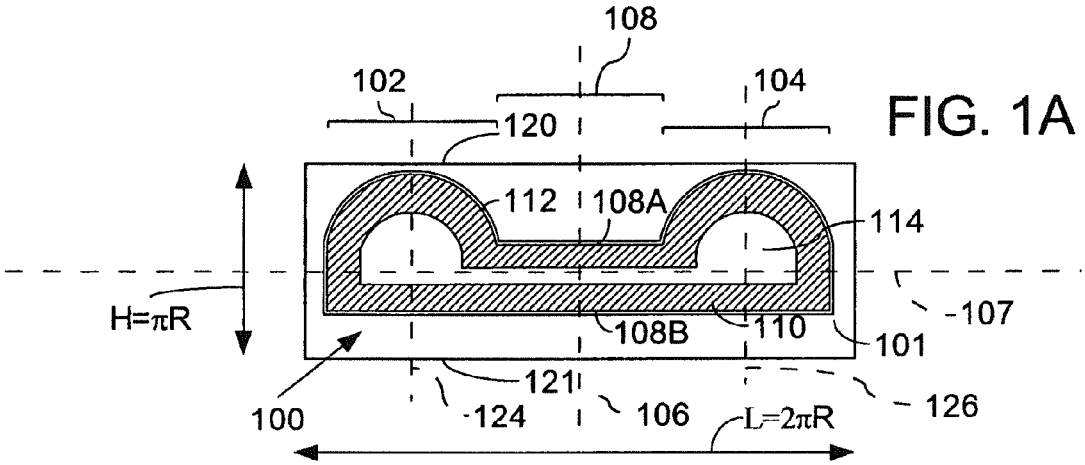
FIGS. 1A-1C are representative planar views of a representative motion graphic.

As used in this application and in the claims, the singular forms "a," "an," and "the" include the plural forms unless the context clearly dictates otherwise. Additionally, the term "includes" means "comprises." The described systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In examples described below, motion graphics are provide that are associated with visual cues for the assessment and estimation of spin or other rotation of a ball such as, for example, a soccer ball or other sporting object. Such motion graphics can be based on hue, saturation, or value (HSV) or other color coordinates of areas defined on an exterior surface. Black and white or contrasting color areas can be used and solid or patterned areas can be used. For example, a particular gray level can be provided as a uniform gray field, or as a plurality of black elements that provides a gray appearance. Conventional logos and colors can be incorporated into such motion graphics, or can be provided in addition to one or more motion graphics.

Some specific examples of motion graphics are described with respect to a particular activity—soccer. This activity is selected as an example because of its worldwide appeal and familiarity. The disclosed motion graphics and related methods are applicable to other team and individual sports such as basketball, baseball, soccer, lacrosse, hockey, rugby, tennis, and football.

Assignment of a specific visual stimulus such as hue, saturation, or value to one or more particular surface areas (zones) can be associated with improved perception. Various kinds of visual stimuli can be used. For central vision or peripheral vision, luminance contrast and object detail can be used to provide an appropriate visual stimulus. For central vision, color characteristics (such as hue or saturation) can be used. Color characteristics can be used for peripheral vision as well but generally tend to be somewhat less effective due reduced peripheral color sensitivity, and total reflectivity based stimuli typically provide superior results. Visual stimuli can be provided using texture, color, gray level, patterning, surface reflectivity, fluorescence, iridescence, or other visually observable surface properties. To preserve traditional appearance, one or more color parameters such as hue, saturation, and value associated with one or more selected surface portions can be configured to provide, for example, a selected contrast, while remaining color parameters are selected to retain a traditional appearance. For example, a relatively dark surface portion can be configured to contrast with a relatively light surface portion while other color parameters are selected in accordance with traditional team colors, logos, and designs. For visual stimuli targeting peripheral vision, gray values can be used that can provide an intended stimulus in a selected zone while not detracting from a traditional team colors or team appearance.

Typically, graphics such as motion graphics are applied to a soccer ball or other ball by providing contrasting visual characteristics to different surface portions. For convenience, one portion of a surface area of a ball can be referred to as a casing, and other portions can be referred to as a graphic portion. Colors, patterns, or other visual characteristics can be assigned to the graphic and casing areas so as to define a motion graphic. In some examples, the casing characteristic is a background characteristic on which a motion graphic and the associated visual characteristics are defined.

Figure 1B:
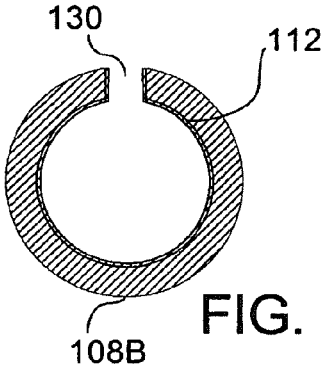
Figure 1C:
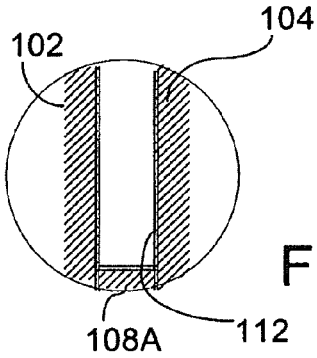

A representative motion graphic 100 is illustrated in FIGS. 1A-1C. For convenience, the motion graphic 100 is illustrated on a flat rectangular background field 101. In a typical implementation, the field 101 corresponds to a spherical surface of, for example, a soccer ball or other ball. As shown in FIG. 1A, a height H corresponds a semi-circumference of a spherical surface of radius R, i.e. $H=\pi R$, and a length L corresponds to a full circumference of a spherical surface of radius R, i.e. $L=2\pi R$. These dimensions are not necessarily shown to scale in FIG. 1A or any other drawing, and it will be apparent that a motion graphic 100 is generally mapped onto a spherical surface (or an approximately spherical surface), not a flat surface as applied to, for example, a soccer ball.

The motion graphic 100 is defined on the field 101 and is symmetric about an axis 106 that is generally a portion of a circular arc of radius R associated with a circumference of a great circle. As used herein, a great circle is a circular section of a sphere that includes a sphere diameter, and circular arcs along great circles are referred to as longitudinal arcs. In some examples, the axis 106 is not associated with a longitudinal arc but a small circle on the sphere, i.e., a circular section that does not includes a sphere diameter. Such arcs are referred to herein as latitudinal arcs.

For convenience, edges 120, 121 of the field 101 are referred to as a top edge and a bottom edge, respectively, although as applied to a sphere, these edges are diametrically opposite locations (poles) of the sphere. A shaded body region 110 of the motion graphic 100 does not extend fully to the edges 120, 121 (i.e., to the poles of the sphere), and typically extends over only about 9/10, 4/5, 3/5, 1/2 or less of a full semicircular arc connecting the edges 120, 121.

The motion graphic 100 includes substantially similar termination portions 102, 104 that are situated symmetrically with respect to the axis 106 and are coupled by a connection portion 108. Typically, the termination portions 102, 104 are situated on a surface of a ball such as a soccer ball so as to be substantially opposite along a diameter of the ball. As shown in FIGS. 1A-1C, the background field 101 and a motion graphic interior 114 are of a common color, shade, or other visual appearance. For convenience, this common appearance is referred to as a common shade. The motion graphic 100 includes the shaded body region 110 and a perimeter 112. The shaded body region 110 is based on a visual appearance that provides a substantial contrast with the field 101. For example, the field 101 can be white, and the body region 110 can be a dark blue. The perimeter 112 is conveniently black, but contrasting colors or patterns can be used, or the perimeter 112 can be omitted.

As noted above, termination portions 102, 104 of the motion graphic 100 typically approach but do not extend to the upper edge 120 of the field 101. In addition, the termination portions 102, 104 are approximately symmetric about respective longitudinal axes 124, 126. As shown in FIG. 1B, viewed looking toward the lower edge 121 (the lower pole), a lower portion 108B of the connection portion 108 and the termination portions 102, 104 are visible and separated by a gap 130. FIG. 1C is a view looking toward the upper edge 120 (the upper pole). With the motion graphic 100 viewed looking toward the upper edge 120, a viewer sees at least parts of the terminal portions 102, 104 and the field 101 as shown in FIG. 1C. An upper part 108A of the connection portion 108 is visible, but is not so pronounced as the termination portions 102, 104. Viewed in either of these directions, rotations about an axis through the poles tends to produce periodic changes in appearance that can be associated with the orientation of the ball with respect to an observer and the axes of rotation.

In use, the motion graphic 100 provides visual clues to ball rotations, and thus permits a participant to assess likely ball trajectories. As noted above, a common rotation rate about different axes produces different visual appearances. In use, rotations are unlikely to be exactly about a particular axis, and the motion graphic 100 thus provides a visual appearance that assists a participant in estimating complex ball rotations.

Spectrally opposite or contrasting colors can provide superior designs. Color coordinates for a representative color pair is tabulated below in Table 1, and FIG. 2 contains spectral reflectances associated with this color pair. This color pair includes a "faded blue" 202 and a "greenish-yellow" 204 that can be applied as either graphic or casing colors, respectively. The colors of this color pair are substantially spectrally opposite as described in Reichow et al., U.S. patent application Ser. No. 10/770,862, which is incorporated herein by reference.

TABLE 1

Figure 2:
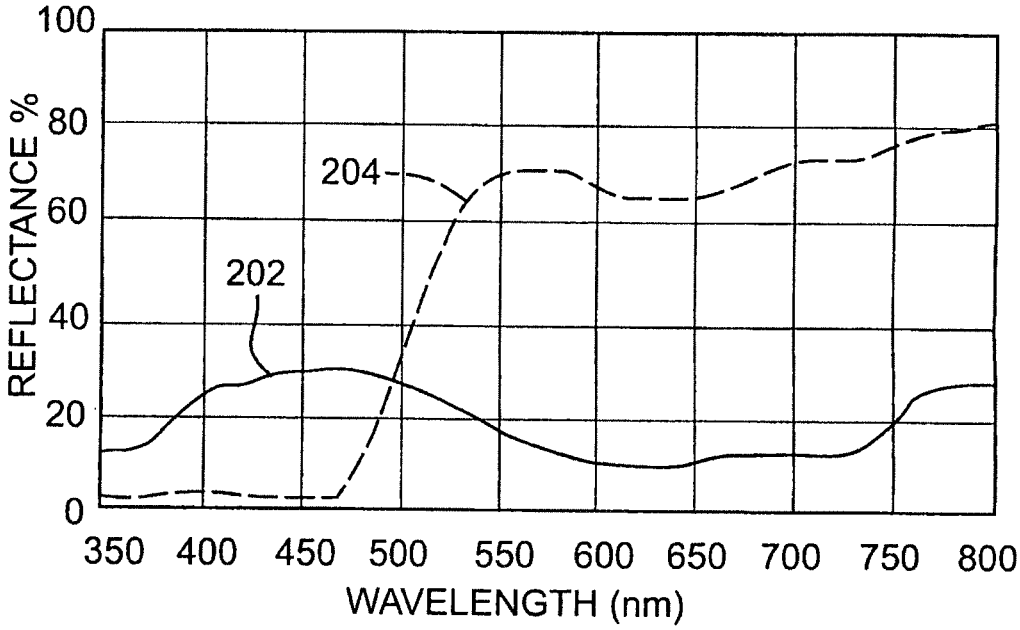
FIGS. 2-3 include spectral transmittances of contrasting color pairs suitable for defining a motion graphic.

Color coordinates associated with the spectral reflectances of FIG. 2.

| Color Coord. | Faded Blue | Greenish-Yellow |
|---|---|---|
| x | 0.2394 | 0.4356 |
| y | 0.2646 | 0.4901 |

TABLE 1-continued

Color coordinates associated with the spectral reflectances of FIG. 2.

| Color Coord. | Faded Blue | Greenish-Yellow |
|---|---|---|
| z | 0.4960 | 0.0743 |
| L | 48.51 | 81.22 |
| a | −18.45 | 6.64 |
| b | −18.14 | 76.58 |

Selection of complementary or opposite colors for a motion graphic defined by graphic and casing colors or otherwise defined can offer significant visual contrast, but such complementary color contrast can be further enhanced by selection of contrasting total reflectances that can be associated with luminance values of, for example, the graphic and the casing. In addition, selection of contrasting graphic/casing colors can provide aesthetically superior visual appearance of, for example, a soccer ball or other item. In addition, selection of these contrasting colors can be based on an anticipated use environment. For example, for a soccer ball that is to be used in matches played on natural grass pitches, colors are preferably selected to enhance mutual contrast between the ball and the grass pitch. In other examples, contrast based on a different background such as blue sky, cloud cover, stadium seating, or other immediate surround to a playing surface such as trees, playground structures, or spectator clothing can be selected.

Figure 3:
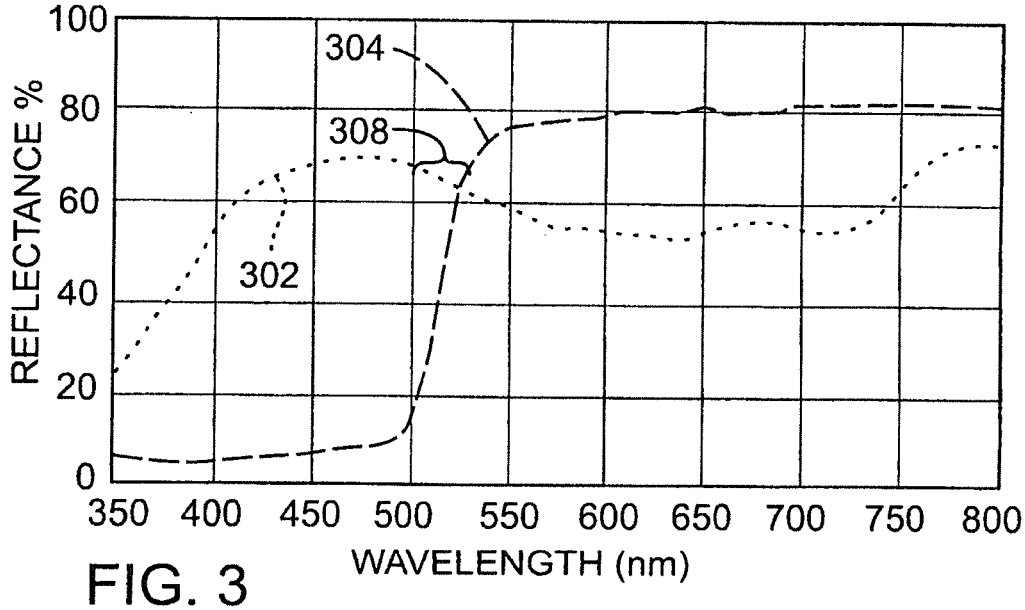

A representative selection of visibility-enhancing coloration based on these additional considerations is illustrated in FIG. 3. Referring to FIG. 3, spectral reflectances 302, 304 that are associated with surfaces areas that appear blue and yellow, respectively. The reflectance curves 302, 304 are configured so that a spectral window 308 is defined in which neither a graphic nor a casing have reflectances that are reduced. As shown in FIG. 3, the spectral window 308 is located in a spectral region associated with green to enhance the appearance of a ball on a typical green (grass) soccer pitch.

Contrasting colors for motion graphics can have CIE X-Y coordinate locations that are widely separated and opposite with respect to the location of a standard white illuminant on a CIE plot. Color coordinates (both x-y-z and L-a-b coordinates) associated with the spectral reflectances of FIG. 3 are listed in Table 2. The CIE dominant wavelengths for the graphic and the casing are approximately 465 nm (blue) and 575 nm (yellow), respectively.

TABLE 2

Color coordinates associated with the spectral reflectances of FIG. 3.

| Color Coord. | (Blue | Yellow |
|---|---|---|
| x | 0.1859 | 0.4559 |
| y | 0.1127 | 0.4771 |
| z | 0.7014 | 0.0670 |
| L | 24.78 | 84.03 |
| a | 0.41 | 17.11 |
| b | −52.29 | 80.63 |

Additional representative examples of complementary spectral reflectance pairs include magenta and green, cyan and red, as well as additional blue/yellow combinations.

Figure 4:
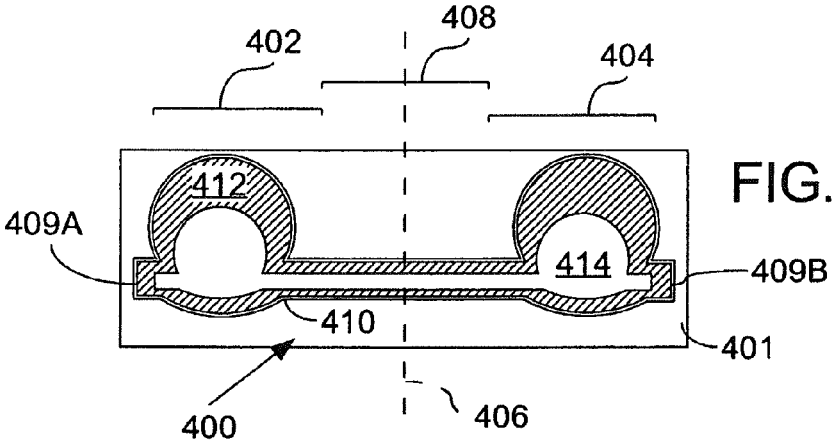
FIG. 4 is a representation of an additional exemplary motion graphic defined in part by curved arcs.

An additional example motion graphic 400 is illustrate in FIG. 4. The motion graphic 400 includes terminal portions 402, 404 that are symmetrically situated with respect to a longitudinal axis 406 (and typically diametrically opposite as applied to a surface of a ball). A connection portion 408 extends from the terminal portion 402 to the terminal portion 404. As shown in FIG. 4, the connection portion 408 includes extensions 409A, 409B that extend beyond the terminal portions 402, 404. A graphic region 412 is provided with a suitable visual characteristic, and the motion graphic 400 is bounded by a perimeter 410. The motion graphic 400 also includes an interior field region 414 that can be selected to produce a visual effect similar to that produced by a background field region 401. For convenience, a planar representation is used in FIG. 4, but the motion graphic is generally applied to a round or spherical surface such as a soccer ball.

Figure 5:
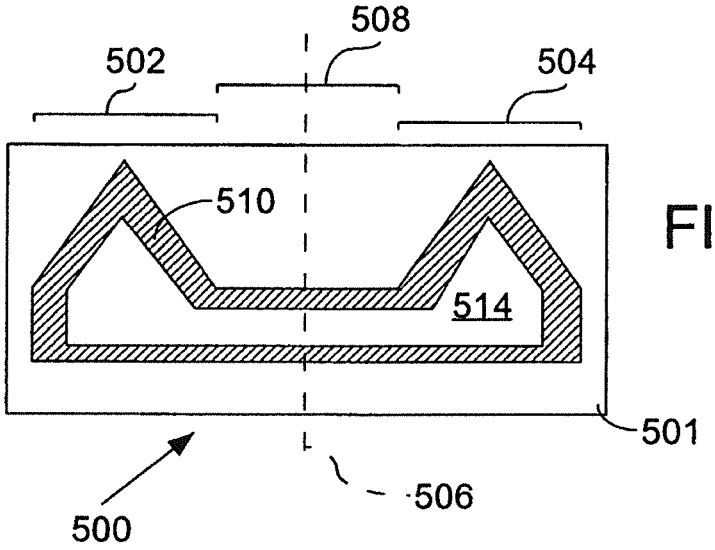
FIG. 5 is a representation of an additional exemplary motion graphic defined by straight line segments.

FIG. 5 illustrates a motion graphic 500 that includes terminal portions 502, 504 that are coupled by a connection portion 508 that define a shaded graphic region 510 that is selected for visual contrast with a background field region 501. The terminal portions are symmetric with respect to a longitudinal axis 506. An interior region 514 is generally configured to be visually similar to the background field 501. The motion graphic 500 is defined by straight line segments and does not include arcs or other curves, but in some examples, both straight line portions (such as portions of polygons) can be used in combination with arc-based portions such as those of FIG. 1A or FIG. 4.

Figure 6:
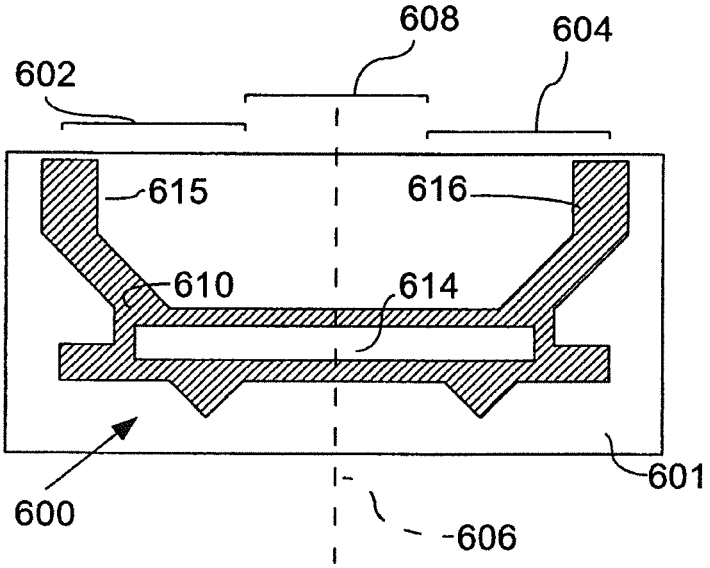
FIG. 6 is an additional example of a motion graphic.

FIG. 6 illustrates another example motion graphic 600 that includes terminal portions 602, 604 that are coupled by a connection portion 608 and that are symmetric with respect to an axis 606. The terminal portions 602, 604 extend both above and below the connection portion 608 and, in combination with the connection portion 608, define an interior region 614. In this example, the interior region 614 does not extend into pattern elements 615, 616 that are part of the termination portions. Typically, a shaded region 610 is configured to provide substantial visual contrast with a background field region 601.

Figure 7:
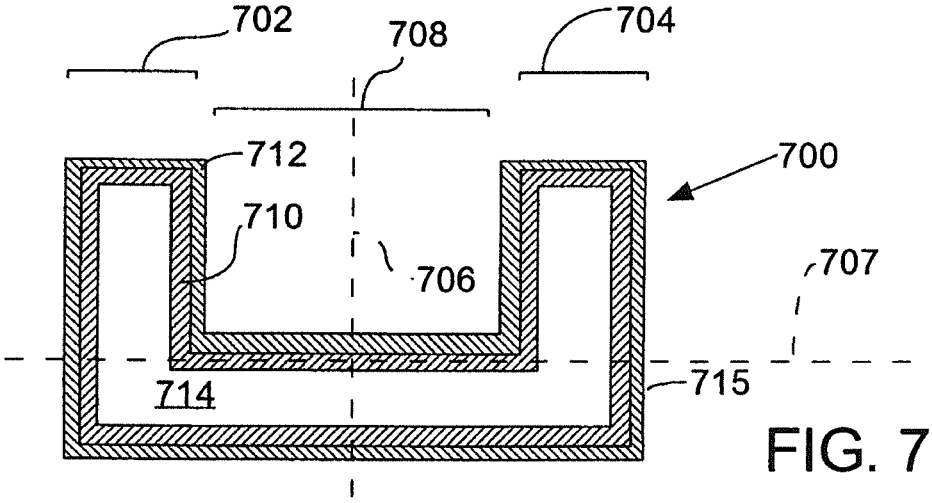
FIG. 7 illustrates a motion graphic that includes a plurality of visually contrasting regions.
Figure 8A:
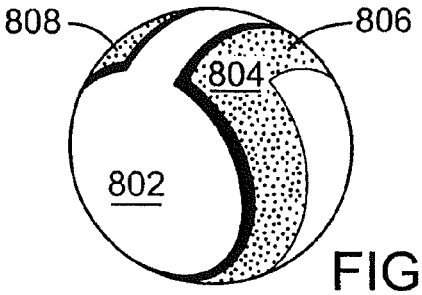
FIGS. 8A-8H are perspective views of a ball that includes a motion graphic.
Figure 8B:
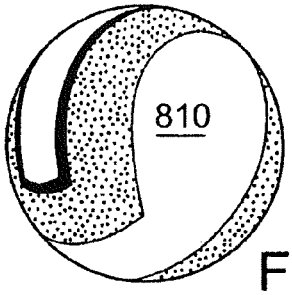
Figure 8C:
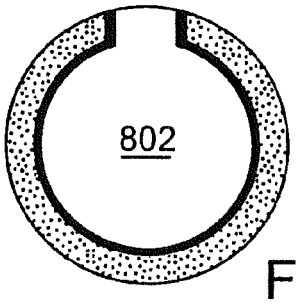
Figure 8D:
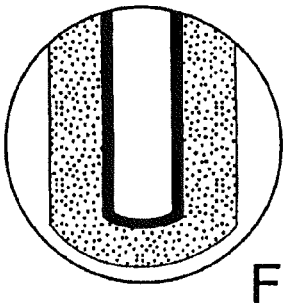
Figure 8E:
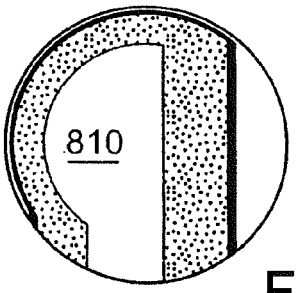
Figure 8F:
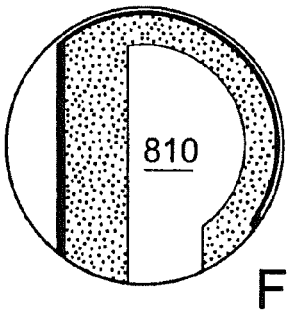
Figure 8G:
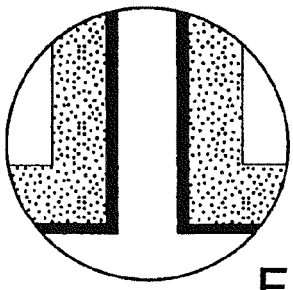
Figure 8H:
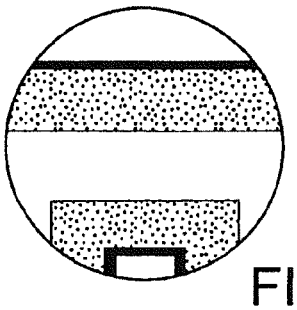

FIG. 7 illustrates another example motion graphic 700 that includes rectangular termination portions 702, 704 that are coupled by a connection portion 708 so as to define an interior region 714. The termination portions 702, 704 are symmetric with respect to a longitudinal axis 706 and asymmetric with respect to a longitudinal axis 707 that is perpendicular to the axis 706. In the example of FIG. 7, interior shaded portions 710, 712 are defined. Typically, these shaded portions provide a similar visual effect that is selected to contrast with a background field area 701 on a ball. For example, differing shades of a common color can be used, or variations in a common texture or similar gray levels can be used. Additional interior shaded regions can also be provided so that appearance can be tailored to provide a traditional appearance, to display team or manufacturer colors, or for other utilitarian or aesthetic reasons. Alternatively, one of the shaded portions 710, 712 can be used for logos or team colors or for some other purpose.

Referring to FIGS. 8A-8H, an illustrative ball includes a motion graphic 804 that is defined on a field 802. The motion graphic 804 includes a semi-perimeter band 808 along a portion of the exterior of the motion graphic 802. The semi-perimeter band 808 is typically defined as a black band that separates the field 802 and the motion graphic 804. As noted above, the semi-perimeter band 808 can be omitted or extended so as to enclose the entire motion graphic 804. Contrasting colors or other contrasting visual stimuli can be provided to the field 802 and the motion graphic 804. An interior region 810 of the motion graphic 804 can be configured to exhibit a visual stimulus similar to that of the field 802.

Figure 9:
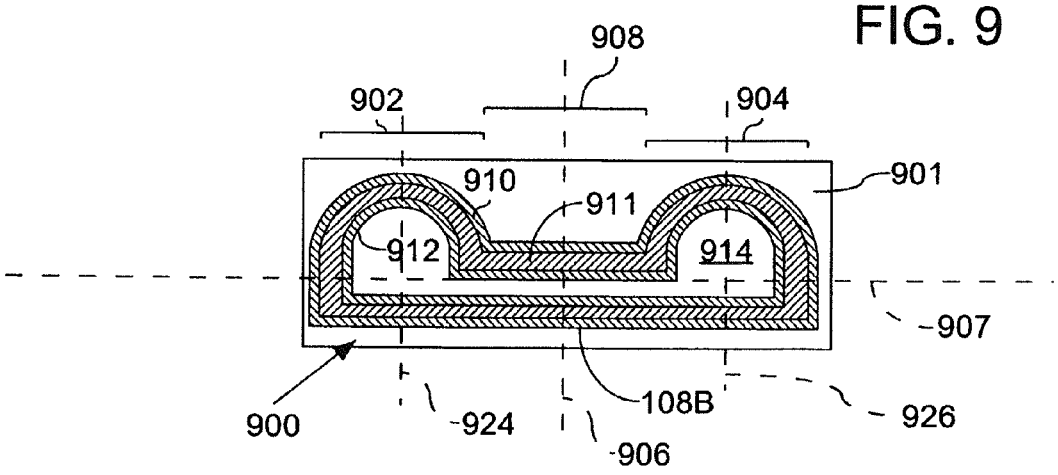
FIG. 9 is representation of an additional illustrative motion graphic.

Another representative motion graphic 900 is illustrated in FIG. 9. The motion graphic 900 is defined with respect to a field region 901, typically a ball casing, and is generally symmetric with respect to an axis 906 that is a portion of a circular arc associated with a circumference of a great circle. Shaded portions 910, 911, 912 are defined by first, second, and third visual stimuli such as colors, patterns, or shades. An interior region 914 generally retains visual a characteristic associated with the casing 901. The motion graphic 900 includes substantially similar termination portions 902, 904 that are situated symmetrically with respect to the axis 906 and are coupled by a connection portion 908. Typically, the termination portions 902, 904 are situated on a surface of a ball such as a soccer ball so as to be substantially opposite along a diameter of the ball. A perimeter can be defined as a contrasting band that encloses all or part of the motion graphic 900.

Figure 10:
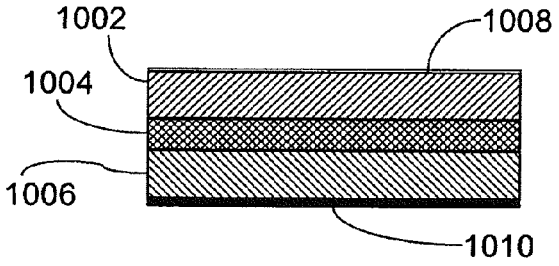
FIG. 10 illustrates a portion of a motion graphic perimeter.

In additional examples, a motion graphic is defined by a first region on a ball that is configured to exhibit a first visual characteristic. The first region is enclosed by a perimeter that includes one, two, three, or more perimeter portions that exhibit second, third, and fourth visual characteristics. FIG. 10 illustrates a representative section of a perimeter that includes perimeter portions 1002, 1004, 1006 that are provided with different visual treatments. In some examples, these visual treatments are related as, for example, different shades of a common color. As shown in FIG. 10, an interior border 1008 and an exterior border 1010 can be provided. These borders typically provide additional contrast, and need not be the same width, pattern, or color, and one or more (or both) can be omitted.

Various example motion graphics are described above. It will be appreciated that these are convenient examples, and that motion graphics can be similarly selected and applied in a variety of sporting applications, and are not limited to soccer or any particular activity. These examples are not to be taken as limiting the scope of the disclosure, and I claim all that is encompassed by the appended claims.

What is claimed is:

1. A ball, comprising:

a first exterior field region associated with a first visual stimulus;

a second exterior field region in which a motion graphic is defined based on a second visual stimulus that is substantially contrasting with the first visual stimulus based on:

a first color for the first visual stimulus and a second color for the second visual stimulus, the first color and the second color having CIE plot locations that are widely separated and opposite with respect to the location of a standard white illuminant;

a first luminance for the first visual stimulus and a second luminance for the second visual stimulus, the first luminance comprising an increased luminance contrast with the second luminance; and a continuous perimeter enclosing the motion graphic, the perimeter including a first continuous perimeter portion exhibiting a first visual characteristic, a second continuous perimeter portion exhibiting a second visual characteristic, and a third continuous perimeter portion exhibiting a third visual characteristic, wherein the first perimeter portion is adjacent to the motion graphic, the third perimeter portion is adjacent to the first exterior field region, and the second perimeter portion is between the first and the third perimeter portions and is wider than the first and the third perimeter portions, and wherein the perimeter portions are non-overlapping.

2. The ball of claim 1, wherein the motion graphic has first and second termination portions that are substantially symmetric with respect to a first longitudinal axis and asymmetric with respect to a second longitudinal axis, the second longitudinal axis being perpendicular to the first longitudinal axis, wherein the first and second termination portions are partially coupled by a connection portion that extends substantially perpendicularly to the first axis.

3. The ball of claim 2, wherein the connection portion extends from the first termination portion to the second termination portion.

4. The ball of claim 2, wherein the motion graphic further comprises an interior region within the connection portion and the termination portions, the interior region associated with the first visual stimulus.

5. The ball of claim 4, wherein the termination portions comprise a truncated annular ring.

6. The ball of claim 5, wherein the truncated annular ring extends along a semicircular arc.

7. The ball of claim 6, wherein a radius of the semicircular arc is less than about 4/5 of a radius of the ball.

8. The ball of claim 6, wherein a height of the motion graphic is less than about 2/5 of a circumference of the ball.

9. A ball, comprising:

an exterior casing;

a motion graphic defined on the exterior casing, wherein the motion graphic comprises selected visual characteristics substantially visually contrasting with respect to the exterior casing based on:

a first color for the exterior casing and a second color for the motion graphic, the first color and the second color having CIE plot locations that are widely separated and opposite with respect to the location of a standard white illuminant;

a first luminance for the exterior casing and a second luminance for the motion graphic, the first luminance comprising an increased luminance contrast with the second luminance; and a continuous perimeter enclosing the motion graphic, the perimeter and including a first continuous perimeter portion exhibiting a first visual characteristic, a second continuous perimeter portion exhibiting a second visual characteristic, and a third continuous perimeter portion exhibiting a third visual characteristic, wherein the first perimeter portion is adjacent to the motion graphic, the third perimeter portion is adjacent to the exterior casing, and the second perimeter portion is between the first and the third perimeter portions, and wherein the first and the third perimeter portions are wider than the second perimeter portion, and wherein the perimeter portions are non-overlapping.

10. The ball of claim 9, wherein the continuous perimeter establishes end portions that are symmetric with respect to a ball longitude, the end portions coupled by a connection region, wherein the first, the second, and the third perimeter portions exhibit selected visual characteristics substantially visually contrasting with respect to the exterior casing, wherein the motion graphic is asymmetric with respect to any longitude perpendicular to the longitude about which the end portions are symmetric.

11. The ball of claim 10, wherein the first, the second, and the third perimeter portions exhibit a common visual characteristic.

12. The ball of claim 11, wherein the common visual characteristic exhibited by the first, the second, and the third perimeter portions comprises the second color, and wherein the first, the second, and the third perimeter portions are configured to exhibit a visual characteristic associated with a different shade of the second color.

13. The ball of claim 12, wherein the exterior casing is provided with the first color that is spectrally opposite that of the second color.

14. The ball of claim 12, wherein the exterior casing is yellow, and the perimeter is blue.

15. The ball of claim 10, wherein the first and the third perimeter portions differ from each other by at least one of:

width;

pattern; and color.

16. The ball of claim 15, wherein the first, the second, and the third perimeter portions are different widths.

17. The ball of claim 15, wherein the exterior casing is provided with the first color that is spectrally opposite to that of the first, the second, and the third perimeter portions.

18. The ball of claim 17, wherein the exterior casing is yellow, and the perimeter is blue.

* * * * *